US008039183B2

(12) United States Patent
Veregin et al.

(10) Patent No.: US 8,039,183 B2
(45) Date of Patent: Oct. 18, 2011

(54) RESIN-COATED PEARLESCENT OR METALLIC PIGMENT FOR SPECIAL EFFECT IMAGES

(75) Inventors: Richard P. N. Veregin, Mississauga (CA); Karen A. Moffat, Brantford (CA); Michael S. Hawkins, Cambridge (CA); Cuong Vong, Hamilton (CA); Eric M. Strohm, Oakville (CA); Wafa Faisul Bashir, Mississauga (CA); Shigang Qiu, Etobicoke (CA)

(73) Assignee: Xerox Corporation, Norwalk, CT (US)

( * ) Notice: Subject to any disclaimer, the term of this patent is extended or adjusted under 35 U.S.C. 154(b) by 793 days.

(21) Appl. No.: 11/924,382

(22) Filed: Oct. 25, 2007

(65) Prior Publication Data

US 2009/0111040 A1 Apr. 30, 2009

(51) Int. Cl.
*G03G 9/08* (2006.01)

(52) U.S. Cl. ..... 430/108.1; 430/108.24; 430/108.6; 430/109.4; 430/110.2; 430/111.1; 430/111.32

(58) Field of Classification Search ..... 430/108.1, 430/108.24, 108.6, 109.4, 110.2, 111.1, 111.32
See application file for complete search history.

(56) References Cited

U.S. PATENT DOCUMENTS

| | | | | |
|---|---|---|---|---|
| 4,734,349 | A * | 3/1988 | Chapman et al. | 430/108.23 |
| 5,223,369 | A * | 6/1993 | Mammino et al. | 430/137.13 |
| 5,753,392 | A * | 5/1998 | Ray et al. | 430/45.1 |
| 5,910,388 | A * | 6/1999 | Ray et al. | 430/108.1 |
| 6,194,117 | B1 * | 2/2001 | Smith et al. | 430/137.17 |
| 6,376,147 | B1 | 4/2002 | Bonsignore et al. | |
| 6,593,049 | B1 | 7/2003 | Veregin et al. | |
| 7,326,507 | B2 * | 2/2008 | Schulze-Hagenest et al. | 430/108.1 |
| 7,745,003 | B2 * | 6/2010 | Hennemann et al. | 428/405 |
| 2002/0098435 | A1 * | 7/2002 | Rohr et al. | 430/108.22 |
| 2005/0277704 | A1 * | 12/2005 | Edwards et al. | 522/71 |
| 2006/0121382 | A1 * | 6/2006 | Choi et al. | 430/108.21 |
| 2007/0238040 | A1 * | 10/2007 | Veregin et al. | 430/107.1 |
| 2008/0193868 | A1 * | 8/2008 | Schuster et al. | 430/108.2 |

FOREIGN PATENT DOCUMENTS

EP 1744223 * 1/2007

OTHER PUBLICATIONS

WO2005/075578 Aug. 18, 2005.*

* cited by examiner

*Primary Examiner* — Hoa Le
(74) *Attorney, Agent, or Firm* — Oliff & Berridge, PLC

(57) ABSTRACT

A pigment particle coated with at least one of a resin and a charge control surface additive, wherein the pigment particle is a pearlescent or metallic pigment. The pigment adds pearlescent effects and is of a size and charge as to be used as a toner material in electrostatographic or xerographic image formation.

17 Claims, 2 Drawing Sheets

RESIN-COATED PEARLESCENT OR METALLIC PIGMENT FOR SPECIAL EFFECT IMAGES

BACKGROUND

The present disclosure relates to resin-coated pearlescent or metallic type pigments for use in forming special effect images, for example using a xerographic or electrophotographic printing devices.

A still desired goal of electrophotography is to be able to print special effects, such as pearlescent or metallic images. While many commercial specialty pigments exist for pearlescent or metallic effects, their particle size is too large to be incorporated into electrophotographic toner particles. Median pigment sizes for commercial pearlescent/metallic pigments range from 5 to >50 microns, which is similar in size or larger than the electrophotographic toner itself. While the large particle size pigments are needed to produce special optical effects, such as metallic reflectivity, both chemical and conventional toner making processes currently available fail to incorporate these large pigments because it is currently not possible to incorporate such large pigment particles in an emulsion aggregation (EA) toner process.

One attempt to combine specialty pigments with toner is to melt-mix a specialty pigment with a toner resin. However, due to the large size of the specialty pigment, even if the toner were 20 or 30 microns in size, the pigment particles would comprise the bulk of the toner. Thus, it would be extremely difficult to jet or print with such toner particles with the inclusion of the specialty pigments, as the toner particles would end up very large. Also, with such large pigments, even a 20-30 micron toner would only have at most only a few specialty pigment particles in each particle, making the toner very inhomogeneous and the effect minimally realized. Many toner particles would have no pigment particle in them, while others would have one or merely a few pigment particles.

SUMMARY

In embodiments, described are toner size pigment particles are be provided with charging characteristics to provide pigment particles that are "toner-like," that is, the pigment particles may be applied as toner due to the charging characteristics. This charging characteristic achieved by way of coating the pigment particles with resin and/or applying surface additives, such as charge control additives to the pigment particles.

In embodiments, described is a pigment particle coated with at least one of a resin and a charge control surface additive, wherein the pigment particle is a pearlescent or metallic pigment.

In further embodiments, described is an image forming process, including in a device having at least two stations, each station including at least a housing for containing a developer material, developing a latent electrostatic image on a photoreceptor at each of the at least two stations, and transferring the developed image to a substrate, wherein the housing of one of the at least two stations contains a developer material comprised of pearlescent or metallic pigments coated with at least one of a resin and a surface additive, and wherein the housing of at least a second station contains a developer material comprised of color toner.

In still further embodiments, described is an image forming process, including charging a photoreceptor, developing a latent electrostatic image on the photoreceptor using at least one color toner and at least one coated pigment particle, wherein the at least one coated pigment particle and the at least one toner are in separate developer units, wherein the pigment particle is coated with at least one of a resin and a surface additive, and wherein the pigment particle is a pearlescent or metallic pigment.

The pigments described herein have utility in providing special effect images in a xerographic marking device.

EMBODIMENTS

Figure 1:
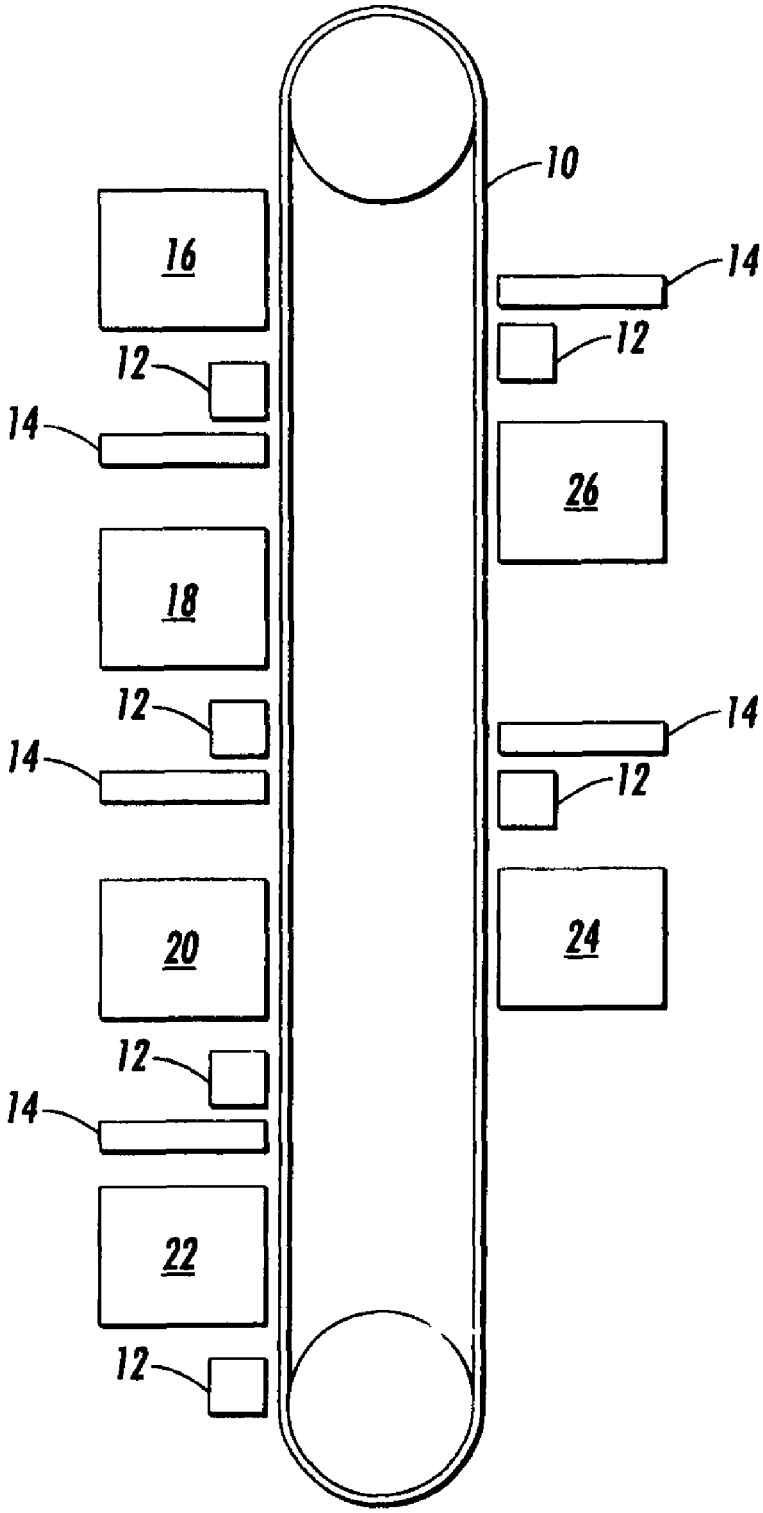
FIG. 1 is a simplified elevation view showing basic elements of a multi-color xerographic printing system that may be used accordance with the present disclosure.

Described are pearlescent and metallic pigments coated with at least one of a resin and a charge control additive. One of ordinary skill in the art will appreciate that many different pearlescent and metallic pigments may be coated as described herein.

In embodiments, special effect pigments include metallic gold, silver, aluminum, bronze, gold bronze, stainless steel, zinc, iron, tin and copper finishes. Examples of commercially available pearlescent and metallic pigments for use herein are Merck IRIODIN 300 "Gold Pearl" and Merck IRIODIN 100 "Silver Pearl, that are mica based pigments with metal oxide particle coatings. Other such metallic color luster pigments from Merck include TIMIRON® Bronze MP60 with a D50 size (50% of the pigments have a volume size of less than a stated size) of 22.0-37.0 microns, TIMIRON® Copper MP-65 D50 size of 22.0-37.0 microns, COLORONA® Oriental Beige D50 size of 3.0-10.0 microns, COLORONA® Aborigine Amber D50 size of 18.0-25.0 microns, COLORONA® Passion Orange with D50 size of 18.0-25.0 microns, COLORONA® Bronze Fine of D50 size of 7.0-14.0, COLORONA® Bronze with D50 size of 18.0-25.0 microns, COLORONA® Bronze Sparkle of D50 size of 28.0-42.0 microns, COLORONA® Copper Fine with D50 size of 7.0-14.0 microns, COLORONA® Copper with D50 size of 18.0-25.0, COLORONA® Copper Sparkle with D50 size of 25.0-39.0 microns, COLORONA® Red Brown with D50 size of 18.0-25.0 microns, COLORONA® Russet with D50 size of 18.0-25.0 microns, COLORONA® Tibetan Ochre with D50 size of 18.0-25.0 microns, COLORONA® Sienna Fine with D50 size of 7.0-14.0 microns. COLORONA® Sienna with D50 size of 18.0-25.0 microns, COLORONA® Bordeaux with D50 size of 18.0-25.0 microns, COLORONA® Glitter Bordeaux, COLORONA® Chameleon with D50 size of 18.0-25.0 microns. Also suitable are Merck mica based pigments with metal oxide particle coatings such as the Merck silvery white pigments including TIMIRON® Super Silk MP-1005 with D50 size of 3.0-10.0 microns, TIMIRON® Super Sheen MP-1001 with D50 size of 7.0-14.0 microns, TIMIRON® Super Silver Fine with D50 size of 9-13 microns, TIMIRON® Pearl Sheen MP-30 with D50 size of 15.0-21.0 microns, TIMIRON® Satin MP-11171 with D50 size of 11.0-20.0 microns, TIMIRON® Ultra Luster MP-111 with D50 size of 18.0-25.0 microns, TIMIRON® Star Luster MP-111 with D50 size of 18.0-25.0 microns, TIMIRON® Pearl Flake MP-10 with D50 size of 22.0-37.0 microns, TIMIRON® Super Silver with D50 size of 17.0-26.0 microns, TIMIRON® Sparkle MP-47 with D50 size of 28.0-38.0 microns, TIMIRON® Arctic Silver with D50 size of 19.0-

25.0 microns, Xirona® Silver with D50 size of 15.0-22.0 microns, RONASTAR® Silver with D50 size of 25.0-45.0 microns.

For very bright colors, other examples from Merck include Colorona® Carmine Red with D50 size of 10.0-60.0 microns giving a Red lustrous effect, COLORONA® Magenta with D50 size of 18.0-25.0 microns, giving a pink-violet lustrous effect, COLORONA® Light Blue with D50 size of 18.0-25.0 microns, to give a light blue lustrous effect, COLORONA® Dark Blue with D50 size of 18.0-25.0 microns to give a dark blue lustrous effect, COLORONA® Majestic Green with 18.0-25.0 microns to give a green lustrous color, COLORONA® Brilliant Green of D5 19.0-26.0 microns to give a Green-golden lustrous color, COLORONA® Egyptian Emerald of D50 18.0-25.0 microns to give a dark green lustrous effect, COLORONA® Patagonian Purple of 18.0-25.0 microns size to give a purple lustrous effect.

In embodiments, mica based special effect pigments from Eckart may also be used, such as DORADO® PX 4001, DORADO® PX 4261, DORADO® PX 4271, DORADO® PX 4310, DORADO® PX 4331, DORADO® PX 4542, PHOENIX® XT, PHOENIX® XT 2001, PHOENIX® XT 3001, PHOENIX® XT 4001, PHOENIX® XT 5001, PHOENIX® PX 1000, PHOENIX® PX 1001, PHOENIX® PX 1221, PHOENIX® PX 1231, PHOENIX® PX 1241, PHOENIX® PX 1251, PHOENIX® PX 1261, PHOENIX® PX 1271, PHOENIX® PX 1310, PHOENIX® PX 1320, PHOENIX® PX 1502, PHOENIX® PX 1522, PHOENIX® PX 1542, PHOENIX® PX 2000, PHOENIX® PX 2000 L, PHOENIX® PX 2001, PHOENIX® PX 2011, PHOENIX® PX 2011, PHOENIX® PX 2021, PHOENIX® PX 2021, PHOENIX® PX 2221, PHOENIX® PX 2231, PHOENIX® PX 2241, PHOENIX® PX 2251, PHOENIX® PX 2261, PHOENIX® PX 2271, PHOENIX® PX 3001, PHOENIX® PX 4000, PHOENIX® PX 4001, PHOENIX® PX 4221, PHOENIX® PX 4231, PHOENIX® PX 4241, PHOENIX® PX 4251, PHOENIX® PX 4261, PHOENIX® PX 4271, PHOENIX® PX 4310, PHOENIX® PX 4320, PHOENIX® PX 4502, PHOENIX® PX 4522, PHOENIX® PX 4542, PHOENIX® PX 5000, PHOENIX® PX 5001, PHOENIX® PX 5310 and PHOENIX® PX 5331.

In further embodiments, special effect pigments such as Silberline aluminum flake pigments may be used, such as 16 micron DF-1667, 55 micron DF-2750, 27 micron DF-3500, 35 micron DF-3622, 15 micron DF-554, 20 micron DF-L-520AR, 20 micron LED-1708AR, 13 micron LED-2314AR 55 micron SILBERCOTE™ PC 0452Z, 47 micron SILBERCOTE™ PC 1291X, 36 micron SILBERCOTE™, 36 micron SILBERCOTE™ PC 3331X, 31 micron SILBERCOTE™ PC 4352Z, 33 micron SILBERCOTE™ PC 4852X, 20 micron SILBERCOTE™ PC 6222X, 27 micron SILBERCOTE™ PC 6352Z, 25 micron SILBERCOTE™ PC 6802X, 14 micron SILBERCOTE™ PC 8152Z, 14 micron SILBERCOTE™ PC 8153X, 16 micron SILBERCOTE™ PC 8602X, 20 micron SILVET®/SILVEX® 890 Series, 16 micron SILVET®/SILVEX® 950 Series.

In embodiments, pearlescent and metallic pigments may be mica flakes coated with titanium dioxide or other transition metal oxides, such as $Al_2O_3$, $Fe_2O_3$, $Fe_3O_4$, $SnO_2$, $Cr_2O_3$ or a combination of two or more transition metal oxides. In embodiments, additional colorant may also be optionally added, such as carmine or ferric ferrocyanide. The pearlescent and metallic pigments may also be metal flakes, such as aluminum flake, which is a common metallic effect pigment.

In embodiments, the pigment has an average size range of from about 5 μm to about 50 μm, for example from about 8 μm to about 30 μm. The pigment size may be measured using any suitable device, for example, a coulter counter as known in the art.

In embodiments, the pigment particles may be provided in conjunction with a resin coating to secure desired electrification-maintaining property and environmental stability. These resins used in the coating may be positively charging for electrophotographic development system that require positive toner, or the resins may be negatively charging for electrophotographic development systems that require negative toner. Examples of resins that may be used in the coating include crosslinked resins, such as phenolic resin and melamine resin, and thermoplastic resin, such as polyethylene and polymethyl methacrylate that are known to be positively charging, and thus would be applicable to pearlescent or metallic toners that are positively charging.

For negatively charging toners, an example of a negatively charging resin that could be used in the coating is amorphous polyester resin. In embodiments, at least one of the polyester resins in the coating would have a high acid value. A "moderate high acid value" may be, for example, an acid value of from about 13 mg/eq. KOH to about 40 mg/eq. KOH, for example, from about 20 mg/eq. KOH to about 35 mg/eq. KOH, or such as from about 20 mg/eq. KOH to about 25 mg/eq. KOH. The acid value may be determined by titration method using potassium hydroxide as a neutralizing agent with a pH indicator. Resins with acid values of about 6 mg/eq. KOH to about 13 mg/eq KOH may also be used in the coatings. Polyester resins with low acid value, such as less than 6 mg/eq KOH, may also be used in combination with a higher acid value resin in the coating, or with a negative charge control additive (CCA). In embodiments, with an appropriate positive CCA, polyesters may be used for positive charging systems as well.

In embodiments, the polyester resin may be synthesized to have high acid numbers, for example, high carboxylic acid numbers. The polyester resin may be made to have a high acid number by using an excess amount of diacid monomer over the diol monomer, or by using acid anhydrides to convert the hydroxl ends to acidic ends, for example by reaction of the polyester with known organic anhydrides such as trimellitic anhydride, phthalic anhydride, dodecyl succinic anhydride, maleic anhydride, 1,2,4,5-benzenedianhydride, 5-(2,5-dioxotetrahydrol)-3-methyl-3-cyclohexene-1,2-dicarboxylic anhydride, 5-(2,5-dioxotetrahydrol)-4-methyl-3-cyclohexene-1,2-dicarboxylic anhydride, pyromellitic dianhydride, benzophenone dianhydride, biphenyl dianhydride, bicyclo [2.2.2]-oct-7-ene tetracarboxylic acid dianhydride, cis,cis, cis,cis, 1,2,3,4-cyclopentane tetracarboxylic acid dianhydride, ethylenediamine tetracetic acid dianhydride, 4,4'-oxydiphthalic anhydride, 3,3',4,4'-diphenylsulfone tetracarboxylic dianhydride, ethylene glycol bis-(anhydro-trimellitate), propylene glycol bis(anhydro-trimellitate), diethylene glycol bis-(anhydro-trimellitate), dipropylene glycol bis-(anhydro-trimellitate), triethylene glycol bis-(anhydro-trimellitate), tripropylene glycol bis-(anhydro-trimellitate), tetraethylene glycol bis-(anhydro-trimellitate), glycerol bis-(anhydro-trimellitate), and mixtures thereof.

Alternatively, a hydroxyl terminated polyester resin may be converted to a high acid number polyester resin by reacting with multivalent polyacids, such as 1,2,4-benzene-tricarboxylic acid, 1,2,4cyclohexanetricarboxylic acid, 2,5,7-naphthalenetricarboxylic acid, 1,2,4naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid; acid anhydrides of multivalent polyacids; and lower alkyl esters of multivalent polyacids; multivalent polyols, such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2 methyl-propanetriol, 2-methyl-1,2,4-butanetriol, trimethylolethane, trimethylolpropane, 1,3,5trihydroxymethylbenzene, mixtures thereof, and the like.

In embodiments, the polyester may be, for example, poly (1,2-propylene-diethylene)terephthalte, polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexylene-adipate polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate, polyethylene-pimelate, polypropylene-pimelate, polybutylene-pimelate, polypentylene-pimelate, polyhexylene-pimelate, polyheptadene-pimelate, poly (propoxylated bisphenol co-fumarate), poly(ethoxylated bisphenol co-fumarate), poly(butyloxylated bisphenol co-fumarate), poly(co-propoxylated bisphenol co ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co ethoxylated bisphenol co-itaconate), poly(1,2-propylene itaconate), or mixtures thereof.

The onset Tg (glass transition temperature) of the polyester resin may be from about 53° C. to about 70° C., such as from about 53° C. to about 67° C. or from about 56° C. to about 60° C. The Ts (softening temperature) of the polyester resin, that is, the temperature at which the polyester resin, softens, may be from about 90° C. to about 135° C., such as from about 95° C. to about 130° C. or from about 105° C. to about 125° C.

In embodiments, the resin is an amorphous polyester. Examples of amorphous polyester resins include branched polyester resins and linear polyester resins.

The branched amorphous polyester resins are generally prepared by the polycondensation of an organic diol, a diacid or diester, and a multivalent polyacid or polyol as the branching agent and a polycondensation catalyst.

Examples of diacid or diesters selected for the preparation of amorphous polyesters include dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and mixtures thereof. The amount of organic diol selected may vary, and more specifically, is, for example, from about 45 to about 52 mole percent of the resin.

Branching agents to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

The amorphous resin may possess, for example, a number average molecular weight (Mn), as measured by gel permeation chromatography (GPC), of from about 10,000 to about 500,000, and for example from about 5,000 to about 250,000; a weight average molecular weight (Mw) of, for example, from about 20,000 to about 600,000, and for example from about 7,000 to about 300,000, as determined by GPC using polystyrene standards; and wherein the molecular weight distribution (Mw/Mn) is, for example, from about 1.5 to about 6, and more specifically, from about 2 to about 4.

In embodiments, the coating process requires that the resin be in the form of dry latex particles in the size range of about 50 nm to about 5 micron in size, so that the resin may be dry blended onto the surface of the pigment particle. The process for making the latex particles involves first generating an emulsion of the polyester. The emulsion of polyester resin may be generated by dispersing the resin in an aqueous medium by any suitable means. For example, the emulsion may be formed by dissolving the polyester resin in an organic solvent, neutralizing the acid groups with an alkali base, dispersing with a mixer in water followed by heating to remove the organic solvent, thereby resulting in a latex emulsion. Desirably, the emulsion includes seed particulates of the polyester having an average size of, for example, from about 10 to about 500 nm, such as from about 10 nm to about 400 nm or from about 250 nm to about 250 nm.

In embodiments, the polyester resin may be dissolved in the organic solvent and neutralized with an alkali base, heated to 60° C. and homogenized at 2000 rpm to 4000 rpm for 30 minutes, followed by distillation to remove the organic solvent.

Any suitable organic solvent may be used to dissolve the polyester resin, for example, alcohols, esters, ethers, ketones and amines, such as ethyl acetate in an amount of, for example, about 1% to about 25%, such as about 10% resin to solvent weight ratio.

The acid groups of the polyester resin may be neutralized with an alkali base. Suitable alkali bases include, for example, sodium hydroxide, potassium hydroxide, lithium hydroxide, ammonium hydroxide, sodium bicarbonate, sodium carbonate, lithium carbonate, lithium bicarbonate, potassium bicarbonate and potassium carbonate. The alkali base may be used in an amount to fully neutralize the acid. Complete neutralization may be accomplished by measuring the pH of the emulsion, for example, pH of about 7.

In embodiments, the at least one polyester resin may be emulsified in water without surfactant, for example by utilizing an alkali base such as sodium hydroxide. The carboxylic acid groups of the polyester are ionized to the sodium (or other metal ion) salt and self stabilize when prepared by a solvent flash process.

The use of a polyester resin synthesized with high acid numbers, for example synthesized with a high carboxylic acid number, thus creates enough ionic stabilization from the resin that nanometer size resin emulsions may be prepared by base neutralization, for example from about pH 6.5 to 7.5, such as about 6.5 to 7, with high shear homogenization without the need for surfactants for stabilization.

In further examples of suitable coating resins, the resin in the latex may be derived from the emulsion polymerization of monomers including styrenes, butadienes, isoprenes, acrylates, methacrylates, acrylonitriles, acrylic acid, methacrylic acid, itaconic or beta carboxy ethyl acrylate (β-CEA) and the like. In embodiments, the resin of the latex may include at least one polymer. In further embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly (alkyl methacrylate-alkyl acrylate), poly(alkyl methacrylate-aryl acrylate), poly(aryl methacrylate-alkyl acrylate), poly (alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile -acrylic acid), poly(styrene-butadiene), poly(styrene-isoprene), poly (styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof. In embodiments, the polymer is poly(styrene/butyl acrylate/beta carboxyl ethyl acrylate). The polymer may be block, random, or alternating copolymers. In further embodiments, the latex may be prepared by a batch or a semicontinuous polymerization resulting in submicron non-crosslinked resin particles suspended in an aqueous phase containing a surfactant.

Surfactants that may be utilized in the latex dispersion may be ionic or nonionic surfactants in an amount of from about 0.01 to about 15, and in embodiments of from about 0.01 to about 5 weight percent of the solids. Anionic surfactants that may be utilized include sulfates and sulfonates such as sodium dodecylsulfate (SDS), sodium dodecyl benzene sulfonate, sodium dodecylnaphthalene sulfate, dialkyl benzenealkyl sulfates and sulfonates, abitic acid, and the NEOGEN brand of anionic surfactants. In embodiments, suitable anionic surfactants include NEOGEN RK available from Daiichi Kogyo Seiyaku Co. Ltd., or TAYCA POWER BN2060 from Tayca Corporation (Japan), that are branched sodium dodecyl benzene sulfonates. Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, mixtures thereof, and the like. Other cationic surfactants include cetyl pyridinium bromide, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. In embodiments, a suitable cationic surfactant includes SANISOL B-50 available from Kao Corp., that is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylere lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. In embodiments, a suitable nonionic surfactant is ANTAROX 897 available from Rhone-Poulenc Inc., which is primarily an alkyl phenol ethoxylate.

In embodiments, the resin of the latex may be prepared with initiators, such as water soluble initiators and organic soluble initiators. Exemplary water soluble initiators include ammonium and potassium persulfates which may be added in suitable amounts, such as from about 0.1 to about 8 weight percent, and in embodiments of from about 0.2 to about 5 weight percent of the monomer. Examples of organic soluble initiators include Vazo peroxides, such as VAZO 64™, 2-methyl 2-2'-azobis propanenitrile, VAZO 88™, 2-2'-azobis isobutyramide dehydrate, and mixtures thereof. Initiators may be added in suitable amounts, such as from about 0.1 to about 8 weight percent, and in embodiments of from about 0.2 to about 5 weight percent of the monomers.

Known chain transfer agents may also be utilized to control the molecular weight properties of the resin if prepared by emulsion polymerization. Examples of chain transfer agents include dodecane thiol, dodecylmercaptan, octane thiol, carbon tetrabromide, carbon tetrachloride and the like in various suitable amounts, such as from about 0.1 to about 20 percent, and in embodiments of from about 0.2 to about 10 percent by weight of the monomer. In embodiments, the resin of the latex may be non-crosslinked; in other embodiments, the resin of the latex may be a crosslinked polymer; in yet other embodiments, the resin may be a combination of a non-crosslinked and a crosslinked polymer. Where crosslinked, a crosslinker, such as divinyl benzene or other divinyl aromatic or divinyl acrylate or methacrylate monomers may be used in the crosslinked resin. The crosslinker may be present in an amount of from about 0.01 percent by weight to about 25 percent by weight, and in embodiments of from about 0.5 to about 15 percent by weight of the crosslinked resin. The resin coating weight % loading ratio to weight % pigment may be varied in effective amounts from about 0.5% to about 30%, such as from about 1% to about 10%.

An example of a method for forming the coating resin on the surface of the pigments is a powder-coat method involving heating and mixing the pigment together with the resin powder. The mixture of resin and pigment is heated to a temperature sufficient so that the resin powder flows sufficiently to completely cover the surface of the pigment. The required temperature varies from about 70° C. to about 200° C., or from about 100° C. to about 160° C. In examples, the resin powder may be a latex prepared by emulsion polymerization that produces the 50 mm to 5 micron sized particles for the coating process. In examples, the resin powder may be prepared by any method that produces particles in the 50 nm to 5 micron sized particles In embodiments, the method for forming the coating resin on the surface of the pigments may be a powder-coat method involving first dry blending 50 nm to 1 micron resin particles onto the pigment surface, followed by heating and mixing the pigment together with the resin powder. The mixture of resin and pigment may be heated to a temperature sufficient so that the resin powder flows sufficiently to completely cover the surface of the pigment. The required temperature varies from about 60° C. to about 160° C., or from about 90° C. to about 140° C.

One of ordinary skill in the art will appreciate that the present disclosure is not limited to powder coating methods. In embodiments, other methods involving solution coating may also be used, such as a dipping method involving dipping of the pigment in a starting material solution for forming a resin coat layer. In such embodiments, the solution comprises at least an appropriate solvent as well as a desired amount of matrix coating resin, optionally with electrically-conductive particulate material and other additives. A spraying method involving the spraying of a resin coat layer-forming solution onto the surface of the pigment could also be used as could a fluidized bed method that comprises spraying a resin coat layer-forming solution onto a pigment being suspended in flowing air. A kneader coating method that comprises mixing a pigment with a resin coat layer-forming solution in a kneader, and then removing the solvent therefrom, is also suitable. In embodiments, the pigment particles may also be dry blended with about 50 nm to about 5 micron resin particles or from about 100 nm to about 300 nm, to effect coating of the pigments.

In embodiments, it is possible to omit the resin coating. However, in such embodiments, the pigment particles should still be blended with and/or coated with charge control additives. Examples of charge control additives that may be applied to the pigment particles in suitable amounts include alkyl pyridinium halides, cetyl pyridinium chloride, cetyl pyridinium tetrafluoroborates, quaternary ammonium sulfate and sulfonate compounds, such as distearyl dimethyl ammonium methyl sulfate, bisulfates and negative charge enhancing additives such as aluminum complexes, ortho-halo phenyl carboxylic acids, complexes of salicylic acids, metal azo dyestuff structures, complexes of a hard acid and a hard base, such as aluminum sulfate, zinc acetate, aluminum acetate, aluminum carbonate, aluminum phosphate, zinc sulfate, zinc carbonate, zinc nitrate, titanium sulfate, titanium acetate, chromium (III) acetate, chromium (III) sulfate, chromium (III) carbonate, magnesium carbonate, magnesium phosphate, magnesium sulfate, magnesium nitrate, cerium carbonate, cerium phosphate, cerium sulfate, cerium nitrate, cobalt carbonate, cobalt phosphate, cobalt sulfate, cobalt nitrate, tin carbonate, tin phosphate, tin sulfate, tin nitrate, ammonium phosphate, ammonium carbonate, or ammonium sulfate, clay particles, and the like. The desired range of a charge control additives ranges from about 0.05 wt % to about 5 wt % of the total composition weight.

In embodiments, the toner particles disclosed herein may have a negative triboelectric charge of from about 10 μC/g to about 80 μC/g, such as from about 15 μC/g to about 70 μC/g or from about 20 μC/g to about 60 μC/g, in both the A-zone and the C-zone. Triboelectric charge may be obtained by placing about 0.5 gram of toner in a glass jar containing about 10 grams of the carrier, for example Xerox Workcentre Pro C3545 carrier. The jar with toner and carrier is then conditioned under the desired environmental conditions, such as A-zone, B-zone or C-zone, overnight. The jar is placed on a Turbula mixer and shaken for about 60 minutes. Triboelectric charge of the developer may then be obtained by the total blow-off method at 55 psi air pressure.

In embodiments, in which the pigments are resin coated, such coating alone may not provide adequate charging or charge control. That is, the resin coat alone may not provide enough electric charge for the pigment particles to perform adequately in a xerographic or electrophotographic process utilizing a photoreceptor. In such embodiments, a charge control additive (CCA) as above may be added to the resin coating.

In embodiments, external additives may be used on the resin coated or CCA coated pigment. For example, toner particles may be blended with an external additive package using a blender such as a Henschel blender. External additives are additives that associate with the surface of the pigment particles. Suitable external additives include external additives used in the art in electrophotographic toners. In embodiments, the external additive package may include one or more of silicon dioxide or silica ($SiO_2$), titania or titanium dioxide ($TiO_2$), and cerium oxide. Silica may be a first silica and a second silica. The first silica may have an average primary particle size, measured in diameter, in the range of, for example, from about 5 nm to about 50 nm, such as from about 5 nm to about 25 nm or from about 20 nm to about 40 nm. The second silica may have an average primary particle size, measured in diameter, in the range of, for example, from about 100 nm to about 200 nm, such as from about 100 nm to about 150 nm or from about 125 nm to about 145 nm. The second silica external additive particles have a larger average size (diameter) than the first silica. The titania may have an average primary particle size in the range of, for example, about 5 nm to about 50 nm, such as from about 5 nm to about 20 nm or from about 10 nm to about 50 nm. The cerium oxide may have an average primary particle size in the range of, for example, about 5 nm to about 50 nm, such as from about 5 nm to about 20 nm or from about 10 nm to about 50 nm.

Zinc stearate may also be used as an external additive. Calcium stearate and magnesium stearate may provide similar functions. Zinc stearate may have an average primary particle size in the range of, for example, about 500 nm to about 700 nm, such as from about 500 nm to about 600 nm or from about 550 nm to about 650 nm.

In further embodiments, the resin may also contain a wax, that may be present in an amount of from about 5% to about 25% by weight of the particles. Examples of suitable waxes include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550 p™, a low weight average molecular weight polypropylene available from Sanyo Kasei K. K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of suitable functionalized waxes include, for example, amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

In embodiments, the resin coated or CCA coated pigment particles may be incorporated into a developer composition. The developer compositions disclosed herein may be selected for electrophotographic, especially xerographic, imaging and printing processes, including digital processes. The developer may be used in image development systems employing any type of development scheme without limitation, including, for example, conductive magnetic brush development (CMB), which uses a conductive carrier, insulative magnetic brush development (IMB), which uses an insulated carrier, semiconductive magnetic brush development (SCMB), which uses a semiconductive carrier, etc. Other options are to use no carrier with the pigment particles in a single-component development system (SCD). In embodiments, the developers are used in SCMB development systems.

Illustrative examples of carrier particles that may be selected for mixing with the toner composition prepared in accordance with the present disclosure include those particles that are capable of triboelectrically obtaining a charge of opposite polarity to that of the toner particles. Illustrative examples of suitable carrier particles include granular zircon, granular silicon, glass, steel, nickel, ferrites, magnetites, iron ferrites, silicon dioxide, and the like. Additionally, there can be selected as carrier particles nickel berry carriers, comprised of nodular carrier beads of nickel, characterized by surfaces of reoccurring recesses and protrusions thereby providing particles with a relatively large external area.

In embodiments, selected carrier particles may be used with or without a coating, the coating generally being comprised of fluoropolymers, such as polyvinylidene fluoride resins, terpolymers of styrene, methyl methacry late, a silane, such as triethoxy silane, tetrafluorethylenes, other known coatings and the like. In embodiments, the carrier coating may comprise polymethyl methacrylate, copoly-trifluoroethyl -methacrylate-methyl methacrylate, polyvinylidene fluoride, polyvinylfluoride copolybutylacrylate methacrylate, copoly perfluorooctylethylmethacrylate methylmethacrylate, polystyrene, or a copolymer of trifluoroethyl-methacrylate and methylmethacrylate containing a sodium dodecyl sulfate surfactant. The coating may include additional additives such as a conductive additive, for example carbon black.

In further embodiments, the carrier core is partially coated with a polymethyl methacrylate (PMMA) polymer having a weight average molecular weight of 300,000 to 350,000 commercially available from Soken. The PMMA may be an electropositive polymer in that the polymer that will generally impart a negative charge on the toner with which it is contacted.

The PMMA may optionally be copolymerized with any desired comonomer, so long as the resulting copolymer retains a suitable particle size. Suitable comonomers may include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

In embodiments, the polymer coating of the carrier core is comprised of PMMA, such as PMMA applied in dry powder form and having an average particle size of less than 1 micrometer, such as less than 0.5 micrometers, that is applied (melted and fused) to the carrier core at higher temperatures on the order of 220° C. to 260° C. Temperatures above 260° C. may adversely degrade the PMMA. Triboelectric tunability of the carrier and developers herein is provided by the temperature at which the carrier coating may be applied, higher temperatures resulting in higher tribo up to a point beyond which increasing temperature acts to degrade the polymer coating and thus lower tribo.

In embodiments, carrier cores with a diameter of, for example, about 5 micrometers to about 100 micrometers may be used. More specifically, the carrier cores are, for example, about 20 micrometers to about 60 micrometers. Most specifically, the carriers are, for example, about 30 micrometers to about 50 micrometers. In embodiments, a 35 micrometer ferrite core available from Powdertech of Japan is used. The ferrite core may be a proprietary material believed to be a strontium/manganese/magnesium ferrite formulation.

In embodiments, polymer coating coverage may be, for example, from about 30 percent to about 100 percent of the surface area of the carrier core with about a 0.1 percent to about a 4 percent coating weight. Specifically, about 75 percent to about 98 percent of the surface area is covered with the micropowder by using about a 0.3 percent to about 1.5 percent coating weight. The use of smaller-sized coating powders may be advantageous as a smaller amount by weight of the coating may be selected to sufficiently coat a carrier core. The use of smaller-sized coating powders also enables the formation of thinner coatings. Using less coating is cost effective and results in less coating amount separating from the carrier to interfere with the triboelectric charging characteristics of the toner and/or developer.

In further embodiments, for example, where a resin coat is absent but applicable with a resin coat, the pigments may be used in combination with a clear (substantially colorless) toner material. Such clear toners are comprised of toner materials without a colorant, such as pigment, dye, mixtures of pigments, mixture of dyes, mixtures of pigments and dyes, and the like. The clear toners may be any suitable toner, including conventional toners or emulsion aggregation toners.

In embodiments, the clear toner may be prepared using any toner resin discussed above. The toner may include a binder in the form of a clear resin toner, for example such as polyesters, polyvinyl acetals, vinyl alcohol-vinyl acetal copolymers, polycarbonates, styrene-alkyl alkyl acrylate copolymers and styrene-aryl alkyl acrylate copolymers, styrene-diene copolymers, styrene-maleic anhydride copolymers, styrene-allyl alcohol copolymers, mixtures thereof and the like. The toner may also include charge control additives such as alkyl pyridinium halides, cetyl pyridinium chloride, cetyl pyridinium tetrafluoroborates, quaternary ammonium sulfate and sulfonate compounds, such as distearyl dimethyl ammonium methyl sulfate, and surface additives such as straight silica, colloidal silica, UNILIN, polyethylene waxes, polypropylene waxes, aluminum oxide, stearic acid, polyvinylidene fluoride, and the like.

In embodiments, pigments may be mixed with clear toner and applied simultaneously to a substrate from a same housing. In further embodiments, clear toner may be applied before or after application of the pigment to a substrate from a separate housing to assist in securing the pigment of the substrate. However, when a clear toner is used, the resin coat applied to the pigments may be omitted, with only CCAs included on the pigments to assist in the electrophotographic transfer process.

In embodiments, a clear topcoat may be added to an image with pigments, with or without clear toner, for toughness/surface resistance.

In embodiments, the topcoat may be an UV curable topcoat. The UV curable topcoat or overcoat may comprise, for example, at least one radiation curable oligomer and/or monomer, at least one photoinitiator, and optionally at least one wax. Suitable UV curable oligomers include acrylated polyesters, acrylated polyethers, acrylated epoxies, and urethane acrylates. Examples of suitable acrylated oligomers include acrylated polyester oligomers, such as EB 81 (UCB Chemicals), CN2200 (Sartomer Co.), CN2300 (Sartomer Co.), and the like, acrylated urethane oligomers, such as EB270 (UCB Chemicals), EB 5129 (UCB Chemicals), CN2920 (Sartomer Co.), CN3211 (Sartomer Co.), and the like, and acrylated epoxy oligomers, such as EB 600 (UCB Chemicals), EB 3411 (UCB Chemicals), CN2204 (Sartomer Co.), CN110 (Sartomer Co.), and the like. Specific examples of suitable acrylated monomers include polyacrylates, such as trimethylol propane triacrylate, pentaerythritol tetraacrylate, pentaerythritol triacrylate, dipentaerythritol pentaacrylate, glycerol propoxy triacrylate, tris(2-hydroxyethyl)isocyanurate triacrylate, pentaacrylate ester, and the like, epoxy acrylates, urethane acrylates, amine acrylates, acrylic acrylates, and the like. Mixtures of two or more materials may also be employed as the reactive monomer. Suitable reactive monomers are commercially available from, for example, Sartomer Co., Inc., Henkel Corp., Radcure Specialties, and the like. The monomers may be monoacrylates, diacrylates, or polyfunctional alkoxylated or polyalkoxylated acrylic monomers comprising one or more di- or tri-acrylates. Suitable monoacrylates are, for example, cyclohexyl acrylate, 2-ethoxy ethyl acrylate, 2-methoxy ethyl acrylate, 2(2-ethoxyethoxy)ethyl acrylate, stearyl acrylate, tetrahydrofurfuryl acrylate, octyl acrylate, lauryl acrylate, behenyl acrylate, 2-phenoxy ethyl acrylate, tertiary butyl acrylate, glycidyl acrylate, isodecyl acrylate, benzyl acrylate, hexyl acrylate, isooctyl acrylate, isobornyl acrylate, butanediol monoacrylate, ethoxylated phenol monoacrylate, oxyethylated phenol acrylate, monomethoxy hexanediol acrylate, beta-carboxy ethyl acrylate, dicyclopentyl acrylate, carbonyl acrylate, octyl decyl acrylate, ethoxylated nonylphenol acrylate, hydroxyethyl acrylate, hydroxyethyl methacrylate, and the like. Suitable polyfunctional alkoxylated or polyalkoxylated acrylates are, for example, alkoxylated, such as, ethoxylated, or propoxylated, variants of the following: neopentyl glycol diacrylates, butanediol diacrylates, trimethylolpropane triacrylates, glyceryl triacrylates, 1,3butylene glycol diacrylate, 1,4-butanediol diacrylate, diethylene glycol diacrylate, 1,6-hexanediol diacrylate, tetraethylene glycol diacrylate, triethylene glycol diacrylate, tripropylene glycol diacrylate, polybutanediol diacrylate, polyethylene glycol diacrylate, propoxylated neopentyl glycol diacrylate, ethoxylated neopentyl glycol diacrylate, polybutadiene diacrylate, and the like. In embodiments, the monomer is a propoxylated neopentyl glycol diacrylate, such as, for example, SR-9003 (Sartomer Co., Inc., Exton, Pa.). Suitable reactive monomers are likewise commercially available from, for example, Sartomer Co., Inc., Henkel Corp., Radcure Specialties, and the like.

Suitable photoinitiators are UV photoinitiators such as hydroxycyclohexylphenyl ketones; other ketones such as alpha-amino ketone and 4-(2-hydroxyethoxy)phenyl-(2-hydroxy-2-propyl)ketone; benzoins; benzoin alkyl ethers; benzophenones, such as 2,4,6-trimethylbenzophenone and 4-methylbenzophenone; trimethylbenzoylphenylphosphine oxides such as 2,4,6-trimethylbenzoyl-diphenyl-phosphine oxide; azo compounds; anthraquinones and substituted anthraquinones, such as, for example, alkyl substituted or halo substituted anthraquinones; other substituted or unsubstituted polynuclear quinines; acetophenones, thioxanthones; ketals; acylphosphines; and mixtures thereof. Other examples of photoinitiators include 2-hydroxy-2-methyl-1-phenyl-propan-1-one and 2-isopropyl-9H-thioxanthen-9-one. Desirably, the photoinitiator is one of the following compounds or a mixture thereof: a hydroxycyclohexylphenyl ketone, such as, for example, 1-hydroxycyclohexylphenyl ketone, such as, for example, IRGACURE 184 (Ciba-Geigy Corp.), a trimethylbenzoylphenylphosphine oxide, such as, for example, ethyl-2,4,6-trimethylbenzoylphenylphosphinate, such as, for example, LUCIRIN TPO-L (BASF Corp.), a mixture of 2,4,6-trimethylbenzophenone and 4-methylbenzophenone, such as, for example, SARCURE SR1137 (Sartomer); a mixture of 2,4,6-trimethylbenzoyl -diphenyl-phosphine oxide and 2-hydroxy-2-methyl-1-phenyl-propan-1-one, such as, for example, DAROCUR 4265 (Ciba Specialty Chemicals); alpha-amino ketone, such as, for example, IRGACURE 379 (Ciba Specialty Chemicals); 4-(2-hydroxyethoxy)phenyl-(2-hydroxy-2-propyl)ketone, such as, for example, IRGACURE 2959 (Ciba Specialty Chemicals); 2-isopropyl-9H-thioxanthen-9-one, such as, for example, DAROCUR ITX (Ciba Specialty Chemicals); and mixtures thereof.

Optional additives include, but are not limited to, light stabilizers, UV absorbers, that absorb incident UV radiation and convert it to heat energy that is ultimately dissipated, antioxidants, optical brighteners, that may improve the appearance of the image and mask yellowing, thixotropic agents, dewetting agents, slip agents, foaming agents, antifoaming agents, flow agents, waxes, oils, plasticizers, binders, electrical conductive agents, organic and/or inorganic filler particles, leveling agents, for example, agents that create or reduce different gloss levels, opacifiers, antistatic agents, dispersants, pigments and dyes, and the like. The composition may also include an inhibitor, such as, a hydroquinone, to stabilize the composition by prohibiting or, at least, delaying, polymerization of the oligomer and monomer components during storage, thus increasing the shelf life of the composition. However, additives may negatively affect cure rate, and thus care must be taken when formulating an overprint composition using optional additives.

The above components of the overcoat composition may be suitably mixed in any desired amount to provide a desired composition. For example, the UV curable overcoat may contains from about 20 to about 95 wt % reactive monomer, from about 0 to about 30 wt % reactive oligomer, from about 0.5 to about 15 wt % UV photoinitiator, and from about 0 to about 60 wt % wax.

A resin coating on the pigment, described above, may or may not alone be sufficient for fusing/adherence of the pigment particles to a substrate. Thus, in embodiments, the pigments may be used in conjunction with a clear toner that provides additional fusing/adherence, as detailed above.

While a particular type of printing apparatus is described herein, it will be understood by one of ordinary skill in the art that the present disclosure may be applied to any type of digital printing apparatus.

FIG. 1 is a simplified elevation view showing portions of a xerographic engine suitable for image-on-image printing of full-color special effect images. In the particular architecture shown in FIG. 1, a series of developer stations successively lay down different colored toners and resin-coated pigments (described in further detail below) on a single photoreceptor, and the accumulated different toners and resin-coated pigments are then transferred to a print sheet, such as a sheet of paper. As shown in FIG. 1, a photoreceptor belt 10 is entrained around a series of rollers, and along the circumference of the photoreceptor belt 10 are disposed a series of charging devices, each indicated as 12, exposure devices indicated as 14, which, as known in the art, could comprise for example an independent laser scanner or LED print bar, and developer stations 16, 18, 20, 22, 24 and 26, which apply appropriately-charged toner and/or resin-coated pigments to the suitably charged or discharged areas created by exposure device 14. While a six-station device is shown, as few as two stations may be used (for example, a first for single color toner such as black and a second for the metallic/pearlescent pigments). A five-station device may also be used as detailed below. In embodiments, additional stations may also be added for additional colors, where desired.

A person of ordinary skill in the art of xerographic printing will appreciate that each of combinations of charge device 12, exposure device 14, and development stations 16, 18, 20, 22, 24 and 26 along the circumference of photoreceptor 10 represents an "image station" capable of placing toner of a particular primary or other color, or a resin-coated specialty pigment, in imagewise fashion on the photoreceptor 10. The location of where these colors or resin-coated pigments are to be placed will, of course, be determined by the various areas discharged by the series of exposure devices 14. There may also be, disposed along photoreceptor belt 10, any number of ancillary devices, such as cleaning corotrons, cleaning blades, and the like, as would be known to one of skill in the art. By causing a particular image area on the photoreceptor belt 10 to be processed by a number of stations, each station corresponding to a color or a resin-coated pigment, it is apparent that a full-color image, comprising imagewise-placed toners of the different primary colors with special effect imaging capabilities, will eventually be built-up on photoreceptor 10. This built-up full-color special effect image is then transferred to a print sheet, such as at transfer corotron, and then the print sheet is fused to fix the full-color special effect image thereon.

In embodiments, instead of using a single photoreceptor belt, each station may include a photoreceptor, and each image developed in each station may be transferred to an intermediate member (belt or drum) substrate, desirably in registration, and then ultimately transferred to a final substrate such as paper. Such a device would be similar to that shown in FIG. 1, with belt 10 being the intermediate member substrate.

Each station will include a housing for containing the developer material to be used in developing a latent image on the photoreceptor. The developer material may either be a color toner, or may be the pearlescent or metallic coated pigments.

As mentioned above, specialty pigments such as pearlescent and metallic pigments are presently too large to be incorporated into other toner particles. Thus, in order to produce special effect images and to overcome the above described problems associated with these large toner size pigments, it is found by the present inventors that the pigments may be used like toner by providing a coating and/or charge agents on the surface of pigments to have similar charging characteristics to that of toner, and thus allowing for the specialty pigments to be separately applied to a photoreceptor.

One potential issue with coating specialty pigments with resin is that resin coating with, for example, an extrusion coating, will at most be 10% of the toner, while the rest will be the pigment particle. Therefore, these particles are unlikely to fuse well on their own. Thus, in order for the specialty pigments to have this charging quality, a coat of resin may be added to the pigments, the process of which is described in detail below. However, to ensure that the resin-coated pigments have an appropriate charge to be applied correctly, in embodiments, it is desired to provide surface charge control additives to provide appropriate tribo electric development transfer and/or cleaning properties. In further embodiments, a clear coat/base coat toner may be added either before or after the resin-coated pigments. The clear coat/base coat toner improves image durability by adding additional resin that aids in fusing all of the toner/pigments together.

In embodiments, any color toner may be added before or after the metallic/pearlescent pigments. Thus, at least one housing that includes the pigments and one housing that includes any color toner, such as clear or black, is included in the system (a basic two housing system). As discussed in detail below, if a full color system is used, typically at least five houses are needed, one for each of the conventional cyan, magenta, yellow and black (CMYK) toners, and one for the metallic/pearlescent pigments.

In a full-color printing system capable of print special effect images, an example of which is shown in FIG. 1, there are provided, in addition to the various primary-color imaging stations such as CMYK, at least one additional imaging station containing a blend of pearlescent or metallic resin-coated and/or charge additive-coated pigments, optionally also including clear toner in the additional housing. The device may alternatively include a further additional imaging station for separate application of clear toner. These stations may be in either order (clear first, or pigment first). Thus, there may be at least six imaging stations, consisting of not only the CMYK imaging stations, but the two additional imaging stations for the pearlescent or metallic coated pigments, and for the clear toner. Still further imaging stations for highlight colors may also be added.

In the special effect printing process described herein, the pearlescent or metallic coated pigment may be placed on top of a base coat. So, for example, a metallic pigment is layered onto white for a silver finish, or a red for a bronze finish. To achieve this, the metallic pigment toner is developed from a $5^{th}$ housing and white or red toner may be developed from a $6^{th}$ housing (the order may be reversed, as the last toner developed is closest to the paper, and will end up on the bottom). Thus, on fusing the white or red toner, the resin on the pigments and toner melt together and fuse the entire image to the paper. In embodiments, a clear toner is developed from the $6^{th}$ housing and the resin-coated pearlescent or metallic pigment is developed in the $5^{th}$ housing. Thus, as just described above, upon fusing, the clear toner aids to fuse all of the toner/pigments to the image. The clear toner may also be developed in the $5^{th}$ housing with the pearlescent or metallic resin-coated pigment developed in the $6^{th}$ housing.

In further embodiments, a clear toner and pearlescent or metallic coated pigments are printed as a blend from the $5^{th}$ or $6^{th}$ housing, the clear toner in the blend providing additional resin to fuse the image together. In embodiments, if the pearlescent or metallic toner, which may or may not also include a clear toner, is printed from the $6^{th}$ housing and additional clear toner is developed from the $5^{th}$ housing to provide an additional protective layer on top of the metallic image. In further embodiments, a clear coat, such as an ultra violet curable overcoat, may be added on the top of the image to secure the pigmented toner to the substrate. This overcoat, could be in addition to a clear toner from a $5^{th}$ or $6^{th}$ housing, or a blend of the pearlescent or metallic "toner" in the $5^{th}$ housing. However, one of ordinary skill in the art will appreciate that many different combinations are possible and well within the scope of the disclosure.

As mentioned above, there is currently no way to include large size specialty pigments with toner, either conventionally or by an emulsion aggregation (EA) process with the necessary size of pearlescent or metallic pigments because, in a EA process, the large pigments would be rejected. Thus, in order to overcome this problem, a process is described herein that allows specialty pigments to be applied separately from toner. For example, the specialty pigments may be provided in conjunction with a resin coating to secure desired electrification-maintaining properties and environmental stability. However, CCAs may also be applied to the specialty pigments either in conjunction with a resin coat, or without the resin coat.

Figure 2:
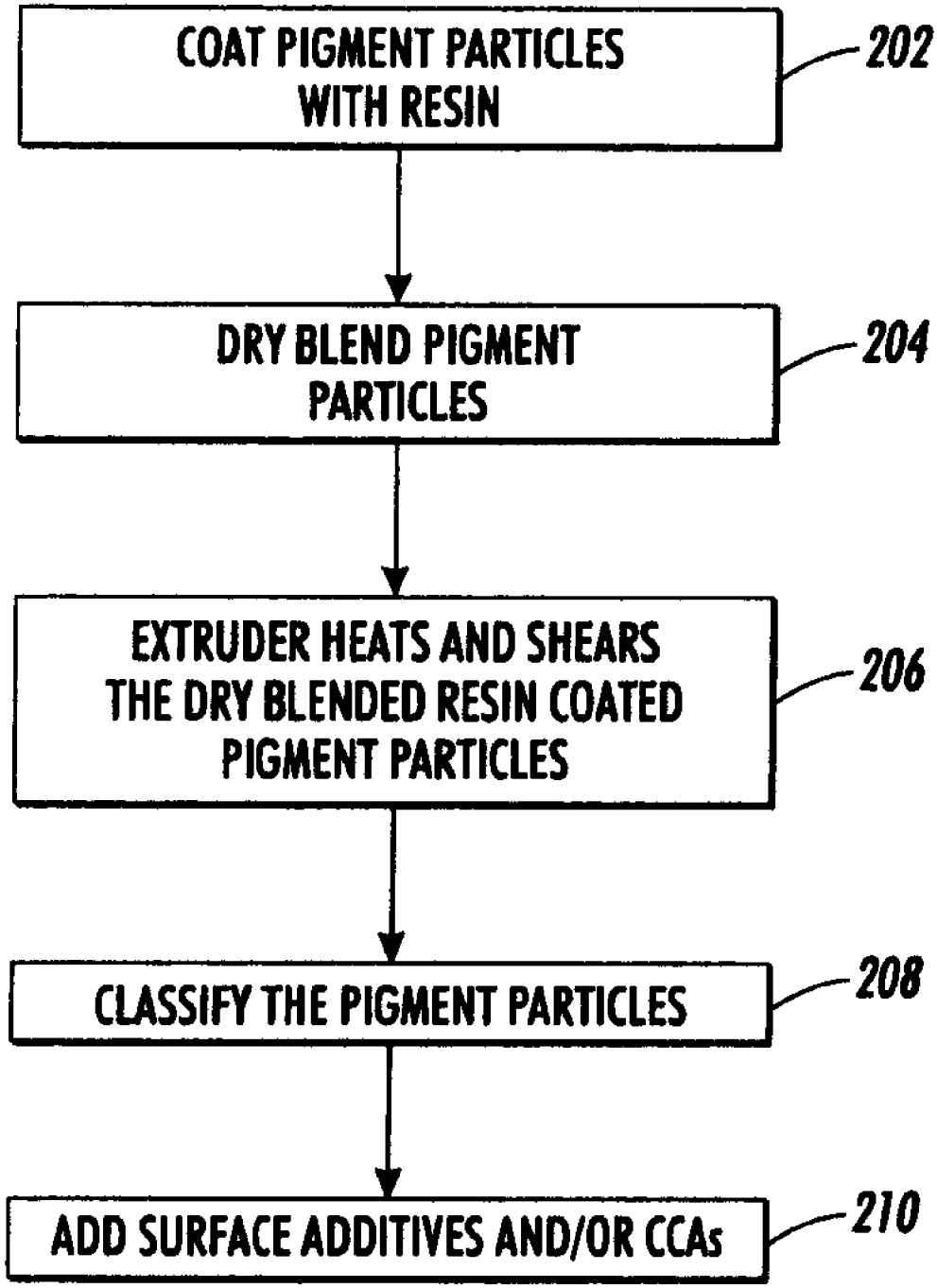
FIG. 2 is a flow chart of a method for coating pigment particles with a resin in accordance with the present disclosure.

Therefore, with reference now to FIG. 2, to enable an image with special effect pearlescent and metallic type finishes, a method whereby the pigment particles are coated with a resin is provided at block 202.

At block 204, the resin-coated pigment particles are dry blended with about 50 to about 300 nm toner resin latex onto the pigment particle surface. In embodiments, a CCA could be added or a color pigment, for example yellow for a gold effect, could be added.

At block 206, the resin-coated pigment particles with latex dispersed on the surface are provided in an extruder, which heats and shears the mixture to fuse the latex onto the surface of the resin-coated pigment particles. This produces pigment particles with about 2% toner latex, and therefore providing the necessary charge that is similar to the parent CMYK toners. Because the extruder has a high shear, it is able to coat about 5% to about 10% of a resin without agglomeration of core particles. In embodiments, a rotary kiln is used in place of the extruder.

At block 208, the resin-coated pigment particles and/or charge control additive pigment particles may be classified. To provide a pearlescent or metallic final image, the toner particles are desired to be, for example, about 5 to about 25 microns in size, or more particularly, about 5 to about 50 microns in size. However, in xerography, it may be more desirable to have tighter size distributions so that the size distribution may be tuned to find a compromise between xerographics and luster. While these larger particle sizes may not give the same image quality as smaller toner particles of CMYK, the effect of the pigment size on image quality also applies to offset printing, as the same large size pigments are used in offset to print pearlescent and metallic.

At step 210, surface CCAs or surface additives may be blended to provide a tribo, development transfer and/or cleaning properties and the like. These surface additives may provide further charging characteristics or may be additives similar to those placed on toner to ensure that image quality is maintained among various conditions, such as, high humidity and low temperatures.

In embodiments, the resin coating steps 202, 204 and 206 may be skipped, and instead only steps 208 and 210 to apply appropriate charge control surface additives may be used.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A developer comprising:

a pigment particle coated with at least one of a resin and a charge control surface additive, wherein the pigment particle is a pearlescent pigment having an average size of from about 5 to 6 microns and comprises zinc stearate as an external additive, the zinc stearate having an average primary particle size in the range of about 500 nm to about 700 nm; and a carrier, including:

a carrier core selected from the group consisting of granular zircon, granular silicon, glass, steel, nickel, ferrites, magnetites, iron ferrites, and silicon dioxide; and a coating selected from the group consisting of polyvinylidene fluoride resin, terpolymers of styrene, methyl methacrylate, and a silane, wherein the carrier core is coated with the coating and the coating covers 75% -98% of the carrier core.

2. The developer of claim 1, wherein the pigment particle is coated with resin, and the resin includes at least one of crosslinked resin, melamine resin, and thermoplastic resin.

3. The developer of claim 1, wherein the pigment particle is coated with a polyester resin.

4. The developer of claim 3, wherein the polyester resin is a linear amorphous polyester resin or a branched amorphous polyester resin.

5. The developer of claim 3, wherein the polyester resin is selected from the group consisting of poly(1,2-propylene-diethylene)terephthlate, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene - sebacate, polyethylene-adipate, polypropylene-adipate, polybutylene-adipate, polypentylene- adipate, polyhexalene-adipate polyheptadene-adipate, polyoctalene-adipate, polyethylene- glutarate, polypropylene-glutarate, polybutylene-glutarate, polypentylene-glutarate, polyhexalene-glutarate, polyheptadene-glutarate, polyoctalene-glutarate, polyethylene- pimelate, polypropylene-pimelate, polybutylene-pimelate, polypentylene-pimelate, polyhexalene-pimelate, polyheptadene-pimelate, poly(propoxylated bisphenol co-fumarate), poly(ethoxylated bisphenol co-fumarate), poly(butyloxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), andpoly(1,2-propylene itaconate).

6. The developer of claim 1, wherein the charge control surface additive includes at least one of aluminum complexes, ortho-halo phenyl carboxylic acids, complexes of salicylic acids, metal azo dyestuff structures, and complexes of a hard acid and a hard base, including aluminum sulfate, zinc acetate, aluminum acetate, aluminum carbonate, aluminum phosphate, zinc sulfate, zinc carbonate, zinc nitrate, titanium sulfate, titanium acetate, chromium (III) acetate, chromium (III) sulfate, chromium (III) carbonate, magnesium carbonate, magnesium phosphate, magnesium sulfate, magnesium nitrate, cerium carbonate, cerium phosphate, cerium sulfate, cerium nitrate, cobalt carbonate, cobalt phosphate, cobalt sulfate, cobalt nitrate, tin carbonate, tin phosphate, tin sulfate, tin nitrate, ammonium phosphate, ammonium carbonate, ammonium sulfate, and clay particles.

7. The developer of claim 1, wherein the pigment particle has a charge of about 10 to about 80 microcoulombs/gram.

8. The developer of claim 1, wherein the pigment particle is coated with resin, and the amount of resin added to the pigment particle is from about 0.5 wt % to about 30 wt % of the weight of pigment particle.

9. The developer of claim 1, wherein the pigment particle is mixed with clear toner particles, and wherein the amount of clear toner particles mixed with the pigment particles is from about 20 to about 80 weight percent of the mixture.

10. An image forming device, comprising at least two stations, each station including at least a housing for containing a developer for developing a latent electrostatic image on a photoreceptor, wherein the housing of one of the at least two stations contains a developer comprising:

a pigment particle coated with at least one of a resin and a charge control surface additive, wherein the pigment particle is a pearlescent pigment having an average size of from about 5 to 6 microns and comprises zinc stearate as an external additive, the zinc stearate having an average primary particle size in the range of about 500 nm to about 700 nm; and a carrier, including:

a carrier core selected from the group consisting of granular zircon, granular silicon, glass, steel, nickel, ferrites, magnetites, iron ferrites, and silicon dioxide, and a coating selected from the group consisting of polyvinylidene fluoride resin, terpolymers of styrene, methyl methacrylate, and a silane, wherein the carrier core is coated with the coating and the coating covers 75% -98% of the carrier core; and wherein the housing of at least a second station contains the developer comprised of color toner.

11. The image forming device of claim 10, comprising five stations, wherein the housing of one of the five stations contains a developer comprised of pearlescent pigments coated with at least one of a resin and a charge control surface additive, and wherein the housing of a remaining four stations each separately contain a developer comprised of one of cyan, magenta, yellow and black color toner.

12. The image forming device of claim 11, further comprising a sixth station in which the housing contains a developer comprised of a substantially colorless toner.

13. The image forming device of claim 10, further comprising a station for applying a UV curable overcoat to the image.

14. The image forming device of claim 10, wherein each station is associated with a single photoreceptor, and the image from each station is formed on the photoreceptor in succession.

15. The image forming device of claim 10, wherein each station includes a photoreceptor, and the image formed at each station on the photoreceptor therein is transferred to an intermediate member with which each station is commonly associated.

16. The image forming device of claim 10, further comprising:

an oil-less fuser member.

17. The developer of claim 1, wherein the pearlescent pigment is a mica based pigment with a metal oxide particle coating.

* * * * *